US008573796B2

(12) United States Patent
Opolka

(10) Patent No.: US 8,573,796 B2
(45) Date of Patent: Nov. 5, 2013

(54) FLASHLIGHT

(75) Inventor: Rainer Opolka, Solingen (DE)

(73) Assignee: Zweibrueder Optoelectronics GmbH, Solingen (DE)

( * ) Notice: Subject to any disclaimer, the term of this patent is extended or adjusted under 35 U.S.C. 154(b) by 101 days.

(21) Appl. No.: 13/188,529

(22) Filed: Jul. 22, 2011

(65) Prior Publication Data

US 2012/0020065 A1 Jan. 26, 2012

(30) Foreign Application Priority Data

Jul. 23, 2010 (CN) ..... 2010 1 0236847
Sep. 21, 2010 (EP) ..... 101778017

(51) Int. Cl.
*F21L 19/00* (2006.01)

(52) U.S. Cl.
USPC ..... 362/171; 362/178

(58) Field of Classification Search
USPC ..... 362/190, 202, 171–173, 178
See application file for complete search history.

(56) References Cited

U.S. PATENT DOCUMENTS

2001/0024367 A1* 9/2001 Shiau ..... 362/188

* cited by examiner

*Primary Examiner* — Julie Shallenberger
(74) *Attorney, Agent, or Firm* — Andrew Wilford

(57) ABSTRACT

A flashlight has a casing extending along an axis and having axially opposite front and rear ends, a collar fittable on the front end, a support disk engaged and gripped axially between the collar and the front end, a light source on a front face of the disk, thermally conductive regions on the disk, and a lamp head secured to the collar.

6 Claims, 2 Drawing Sheets

Fig. 2a
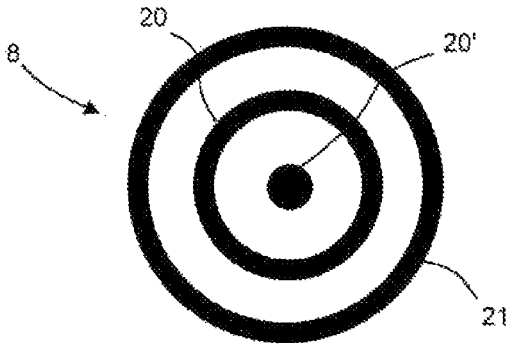
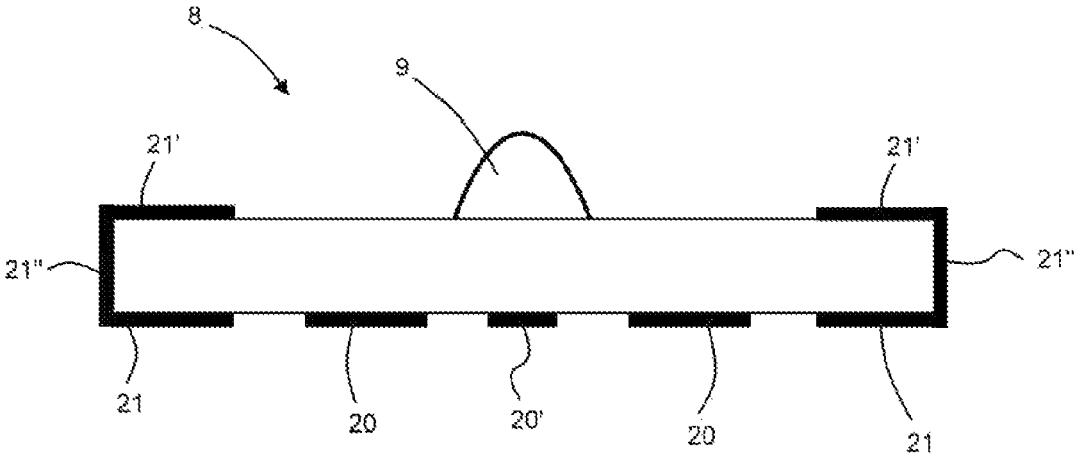
Fig. 2b

FLASHLIGHT

FIELD OF THE INVENTION

The present invention relates to a flashlight.

BACKGROUND OF THE INVENTION

A standard flashlight has a normally cylindrical casing, a light source, a lamp-head collar and a lamp head. A variety of different shapes and configurations of flashlight is known, often having a plurality of parts that have to be assembled in the factory in a complicated manner and thus with high labor costs. In addition, there are increased production costs that, due to the high number of different components, are relatively high.

However, a reduction of the parts is often at the expense of a long surface life and durability of the flashlight because certain components have to carry out different functions at the same time within the flashlight.

OBJECTS OF THE INVENTION

It is therefore an object of the present invention to provide an improved flashlight.

Another object is the provision of such an improved flashlight that overcomes the above-given disadvantages, in particular that is made of as few parts as possible, has a compact design and, at the same time, functions reliably.

SUMMARY OF THE INVENTION

A flashlight has according to the invention a casing extending along an axis and having axially opposite front and rear ends, a collar fittable on the front end, a support disk engaged and gripped axially between the collar and the front end, a light source on a front face of the disk, thermally conductive regions on the disk, and a lamp head secured to the collar.

Overall, beside the standard components, namely the casing including an end cap and a battery cartridge, and the lamp-head collar, no further parts are necessary to build a reliably functioning flashlight. In particular, an additional element by means of which the support disk is connected to the casing is no longer required.

Preferably, a light-emitting diode (LED) is used as light source that, despite putting out considerable light, produces comparatively little heat. In addition, compared to conventional light bulbs, LED's are characterized by their durability.

According to a preferred configuration of the present invention, the support disk has circular and/or annular electrical contacts mounted concentrically on its outer edge and on its back face. This configuration of electrical contact surfaces is particularly suitable for flashlights in which the batteries are mounted in a battery cartridge because the latter, independent of its angular alignment, is always connected to the electrical contact surface. However, this can also be eliminated as long as it is ensured that the electrical connection between the battery cartridge and the support disk is closed, which can be done, for example, by fitting the battery cartridge to a groove in the housing.

Preferably, the support disk has an annular, thermally conductive abutment surface on its outer edge that, in the assembled condition, engages the casing. Provision of the thermally conductive abutment surface, ensures that the entire support is cooled by effectively dissipating the heat to the casing, so the durability of the used light source is increased. As preferred materials, in particular aluminum, brass or copper are suitable here.

However, it is also possible that the abutment surface on edge is thermally conductive not only on its outer edge surfaces. In order to increase the cooling of the support it is advantageous that the support disk has a outer surface that is formed as thermally conductive surface and, in the assembled condition, engages a tubular section of the casing. Moreover, the support disk can have thermally conductive surfaces also on the lamp head face that, in the assembled condition, engage an abutment face of the lamp-head collar.

In order to ensure a secure hold of the support within the flashlight, the lamp-head collar and the casing have respective abutment shoulders for the positive-locking mounting of the support, between which abutment shoulders the support disk is held in the assembled condition. The respective abutment surfaces are configured in a thermally conductive manner so that the heat generated at the LED can be dissipated in an optimal manner.

Preferably, the lamp-head collar and the casing are connected to each other by a screwthread that is comparatively robust and, at the same time, can be manufactured in a simple manner. In addition, the lamp head and the lamp-head collar are also threaded to each other, for which purpose the lamp head and the lamp-head collar have complementary internal and external screwthreads. A potentially installed reflector lens can be mounted therebetween so that it is captured between the lamp head and the lamp-head collar. Alternatively, the reflector lens can also have a separate threaded section so that it can be screwed into the lamp head, and the lamp head can also be screwed directly onto the casing. This way, the number of parts used is reduced by the part formed by the lamp-head collar, which saves further assembly costs. Of course, it is also possible to fasten the reflector lens in the lamp head by means of a separate support that, for example, can be a cylinder with an adequate external thread. In such a configuration, the lamp head and the lamp-head collar are formed as one piece.

BRIEF DESCRIPTION OF THE DRAWING

The above and other objects, features, and advantages will become more readily apparent from the following description, reference being made to the accompanying drawing in which:

FIG. 2*a* is a rear view of a detail of the flashlight; and

FIG. 2*b* is a cross-section through the detail of FIG. 2*a*.

DETAILED DESCRIPTION

Figure 1A:
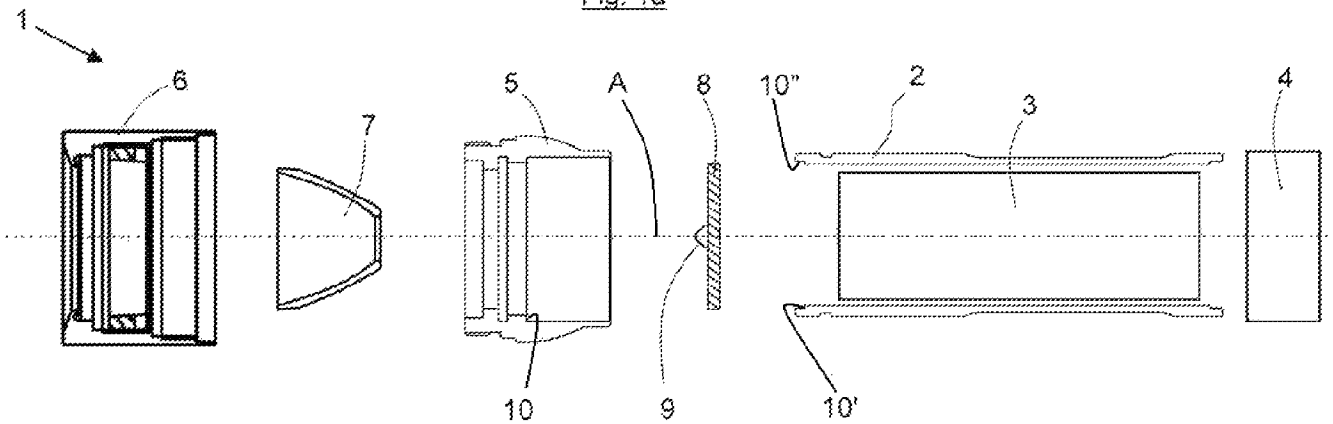
FIG. 1*a* is an exploded view of a flashlight according to the invention.
Figure 1B:
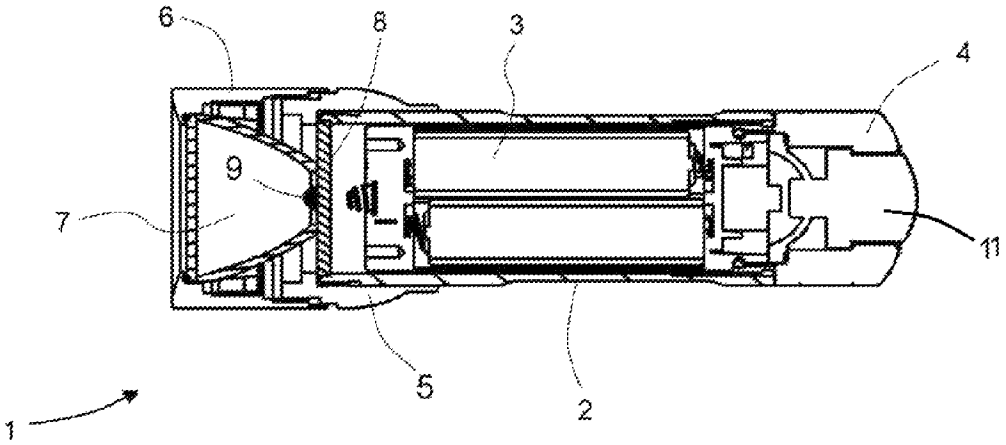
FIG. 1*b* is an axial section through the assembled flashlight.

As seen in FIGS. 1*a* and 1*b* a flashlight 1 comprises a cylindrically tubular casing 2 centered on an axis A and holding a battery cartridge 3, an end cap 4, a lamp-head collar 5, a lamp head 6, a reflector lens 7, and a support 8 on which an LED 9 can be mounted.

In the assembled condition (FIG. 1*b*), the support 8 is a basically flat circular disk positively held between an axially forwardly directed shoulder 10' of the casing 2 and an axially rearwardly directed shoulder 10 of the lamp-head collar 5. The front end of the casing 2 has a cylindrical inner surface 10" terminating rearward at the shoulder 10' and dimensioned to fit around the cylindrical outer periphery of the disk 8. In the illustrated embodiment the lamp head 6 and lamp-head collar 5 are formed as two pieces, the reflector lens 7 being a separate piece held therebetween.

In order to ensure an optimal electrical contact between the battery cartridge 3 and the support disk 8, it has as best shown in FIGS. 2*a* and 2*b* on its planar back face a central contact 20' of circular shape, an intermediate circular contact ring 20 centered on the axis A and spaced radially outward from the center contact 20', and an outer contact ring 21 also centered on the axis A and extending all the way to the outer periphery or edge of the support disk 8. This outer contact ring 21 is part of a U-shaped contact assembly 21, 21', 21" that has a cylindrical part 21" covering the cylindrical outer edge of the disk and a flat ring part 21' like the contact 21 that lies on the outer edge of the front face of the disk 8. This contact assembly 21, which is made of copper or another highly thermally and electrically conductive material, bears on the shoulder 10' and the surface 10" of the casing 2, which can also be made of metal to be thermally and electrically conductive. Overall, by means of these three thermally conductive surfaces, an optimal heat dissipation is created that increases the durability of the LED many times over.

The LED light source 9 is centrally mounted on the front face of the disk 8 and is connected via unillustrated conductors or traces to the contacts 20, 20', and or 21 for connection to the battery pack 3 that can be connected, for instance to the casing 2 via a switch 11 in the end cap 4.

I claim:

1. A flashlight comprising:

a casing extending along an axis and having axially opposite front and rear ends and formed at the front end with a flat and axially forwardly directed annular shoulder surface and thereadjacent with a radially inwardly directed cylindrical inner surface;

a collar fittable on the front end and formed with a rearwardly directed flat and annular shoulder surface, both shoulder surfaces and the inner surface being thermally conductive;

a support disk having an outer edge, a front face, and a back face, the outer edge being engaged and gripped axially between the shoulder surfaces of the collar and the front end;

a light source on the front face of the disk;

thermally conductive front, back and side parts respectively on the front face, back face, and outer edge of the disk, the front part being flat and annular and bearing axially forward on the rearwardly directed shoulder surface of the collar, the side part being cylindrical and radially outwardly engaging the inner surface of the casing, and the rear part being flat and annular and bearing axially rearward on the shoulder surface of the casing; and a lamp head secured to the collar.

2. The flashlight defined in claim 1 wherein the light source is a light-emitting diode.

3. The flashlight defined in claim 1, further comprising interengaging screwthreads on the casing and collar.

4. The flashlight defined in claim 1, further comprising interengaging screwthreads on the collar and head.

5. The flashlight defined in claim 1 wherein the lamp head and collar are unitary.

6. A flashlight comprising:

a tubular casing extending along an axis having a front end formed with an internal axially forwardly directed shoulder and with a radially inwardly directed cylindrical inner surface;

a battery pack in the casing;

a collar threaded on the front end and formed with an axially rearwardly directed shoulder;

a disk having an outer edge, a front face, and a rear face, the outer edge being engaged between the shoulders;

a light source on the front face of the disk;

a contact ring on the rear face of the disk, centered on the axis, and engaging the battery pack and connected to the light source; and a thermally conductive region on the disk in direct engagement with both of the shoulders and with the inner surface of the casing and transmitting heat from the light source and the disk to the casing and collar.

* * * * *